US005406764A

United States Patent [19]

Van Auken et al.

[11] Patent Number: 5,406,764

[45] Date of Patent: * Apr. 18, 1995

[54] MESH ROOF FACING SYSTEM

[76] Inventors: Richard H. Van Auken, 5217 W. 67th St., Prairie Village, Kans. 66208; Lawrence D. Englehart, 151 21st Ter. SE., Largo, Fla. 34641; Ralph C. Hall, 5930 Hunter Rd., Enon, Ohio 45323

[ * ] Notice: The portion of the term of this patent subsequent to Oct. 12, 2010 has been disclaimed.

[21] Appl. No.: 70,195

[22] Filed: Jun. 2, 1993

Related U.S. Application Data

[63] Continuation-in-part of Ser. No. 637,334, Jan. 3, 1991, Pat. No. 5,251,415.

[51] Int. Cl.[6] ..... E04B 7/00

[52] U.S. Cl. ..... 52/408; 52/96; 52/63; 52/676; 52/741.3; 52/745.06; 52/748; 52/506.05

[58] Field of Search ..... 52/408–410, 52/506.5, 512, 676, 96, 90.1, 63, DIG. 12, 741.1, 741.3, 745.05, 745.06, 748, 404.1

[56] References Cited

U.S. PATENT DOCUMENTS

| | | | |
|---|---|---|---|
| 4,885,879 | 12/1989 | Plantier | 52/63 |
| 5,197,239 | 3/1993 | Glynn et al. | 52/DIG. 12 X |
| 5,210,152 | 4/1993 | Heffner | 52/DIG. 12 X |

*Primary Examiner*—Carl D. Friedman
*Assistant Examiner*—Robert J. Canfield
*Attorney, Agent, or Firm*—Shoemaker and Mattare, Ltd.

[57] ABSTRACT

A roofing system includes a strong nonmetallic mesh placed over an array of purlins, and secured to the periphery of the roof. Metal roofing panels, insulation, and a weatherproof layer are laid over the mesh. The mesh has sufficient strength to protect workers on the roof from falls, and sufficiently small openings to catch dropped tools and fasteners.

9 Claims, 4 Drawing Sheets

MESH ROOF FACING SYSTEM

This is a continuation-in-part of application Ser. No. 07/637,334, filed Jan. 3, 1991, now U.S. Pat. No. 5,251,415.

BACKGROUND OF THE INVENTION

This invention relates to building construction, and particularly to a mesh roof system for buildings, especially metal buildings with insulated roofs.

Expanded metal, metal screen, and other types of mesh have been proposed previously for use in constructing walls and ceilings of buildings. In some cases, as in U.S. Pat. No. 4,522,004, cementitious material or plaster is applied over the mesh. Mesh has also been used to support or retain insulating material, as in U.S. Pat. No. 2,148,281 and wire mesh reinforcement has been proposed, as in U.S. Pat. No. 4,047,436.

In U.S. Pat. No. 3,506,746, a net supported by poles serves as a support for receiving plaster, which hardens to form a structure in which doors and windows are subsequently cut. U.S. Pat. No. 525,301 describes a method of constructing an arched roof by applying concrete or cement to a corrugated wire mesh supported by structural beams.

U.S. Pat. No. 4,557,092 describes an insulating blanket having a strong scrim layer attached to its fiber barrier, to resist falling objects. It has been found difficult, however, to create joints of sufficient strength in such material to prevent heavy objects from falling through.

Finally, flexible materials have been used to support ceiling insulation in a dropped ceiling construction, as shown in U.S. Pat. No. 3,791,089.

None of the above patents adequately addresses the issue of worker safety, which is a particular object of this invention.

We are especially concerned with construction worker safety. Unfortunately, injuries occur from time to time during roof construction, either to workmen who fall, or to those below, from dropped objects. It is therefore standard and required practice to provide safety netting or other material below roof installers to protect them and those below, and/or to require workers to be tied or tethered to the structure.

Dropped tools and hardware are another problem. The safety netting designed to catch falling workmen is generally of a sufficiently large mesh (e.g., six inch mesh) to allow small tools, fasteners, and other construction materials to pass through. Conventional practice is to deploy a separate, smaller mesh debris net below the safety netting.

Tethers are only temporarily effective. When one neglects to apply a required tether, or while it is being moved, the workman and those below him are at risk. It would be better to have a restraint that could not be avoided, and did not require a positive act to be effective. That is, a restraint analogous to and automobile air bag is preferred over one analogous to a seat belt. Additionally, it would be preferably to use safety netting that would become part of the roof, to save the labor of removing the netting.

We have found that a very simple, attractive and durable insulated roof can be constructed with a strong mesh fabric layer that reduces the likelihood and severity of construction accidents resulting from falling objects, and also forms a permanent part of the roof.

SUMMARY OF THE INVENTION

An object of the invention is to improve worker safety while constructing a roof comprising a plurality of transverse beams, an array of spaced, parallel purlins each extending orthogonal to the beams, and corrugated sheet metal decking panels laid across and supported by the purlins.

The improvement comprises a nonmetallic mesh safety net installed over and supported by the purlins, beneath the decking panels. A layer of insulating material is preferably included as well, supported by the decking, between the mesh and the roof panels. Finally, the roof includes a top layer which is weatherproof.

DESCRIPTION OF THE PREFERRED EMBODIMENT

Figure 1:
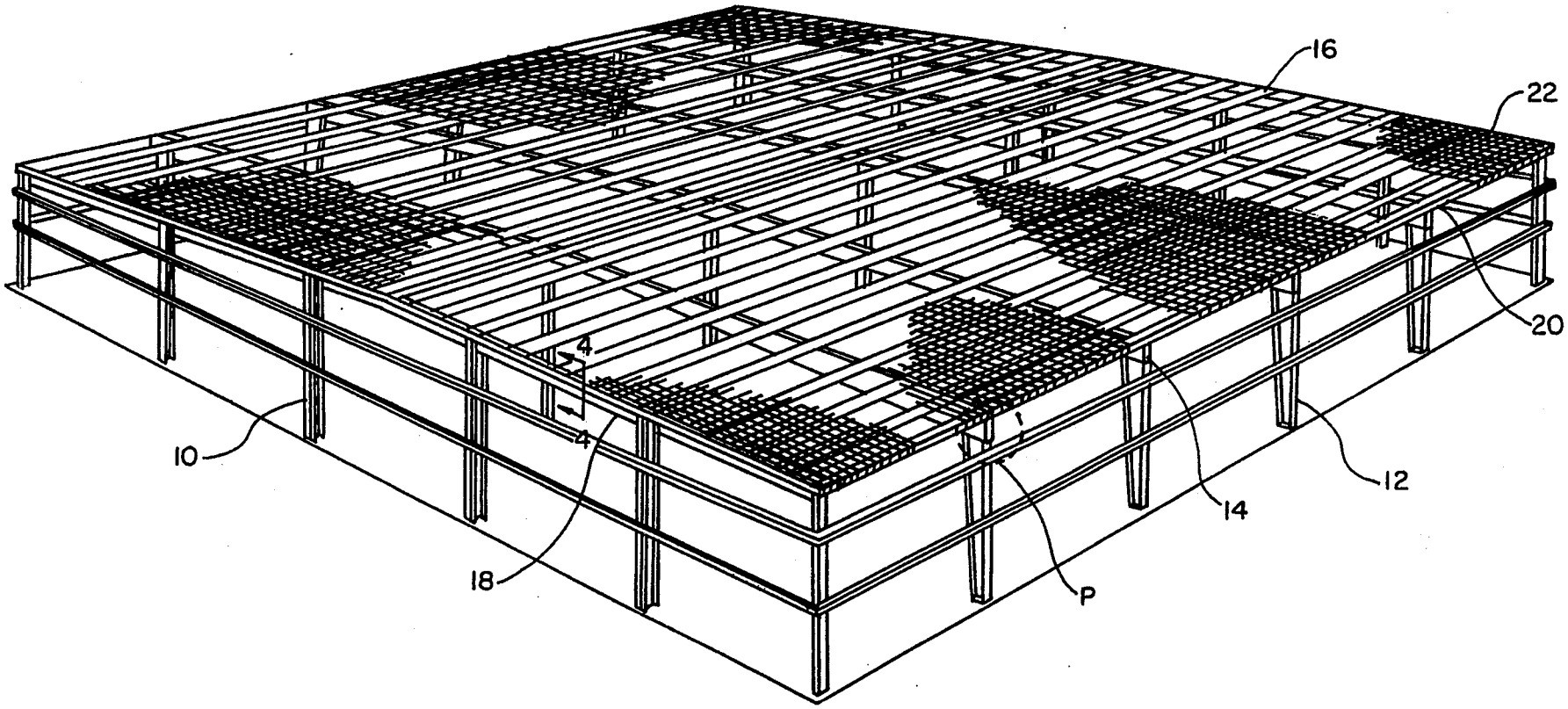
FIG. 1 is an isometric view of a partially constructed roof embodying the invention.
Figure 5:
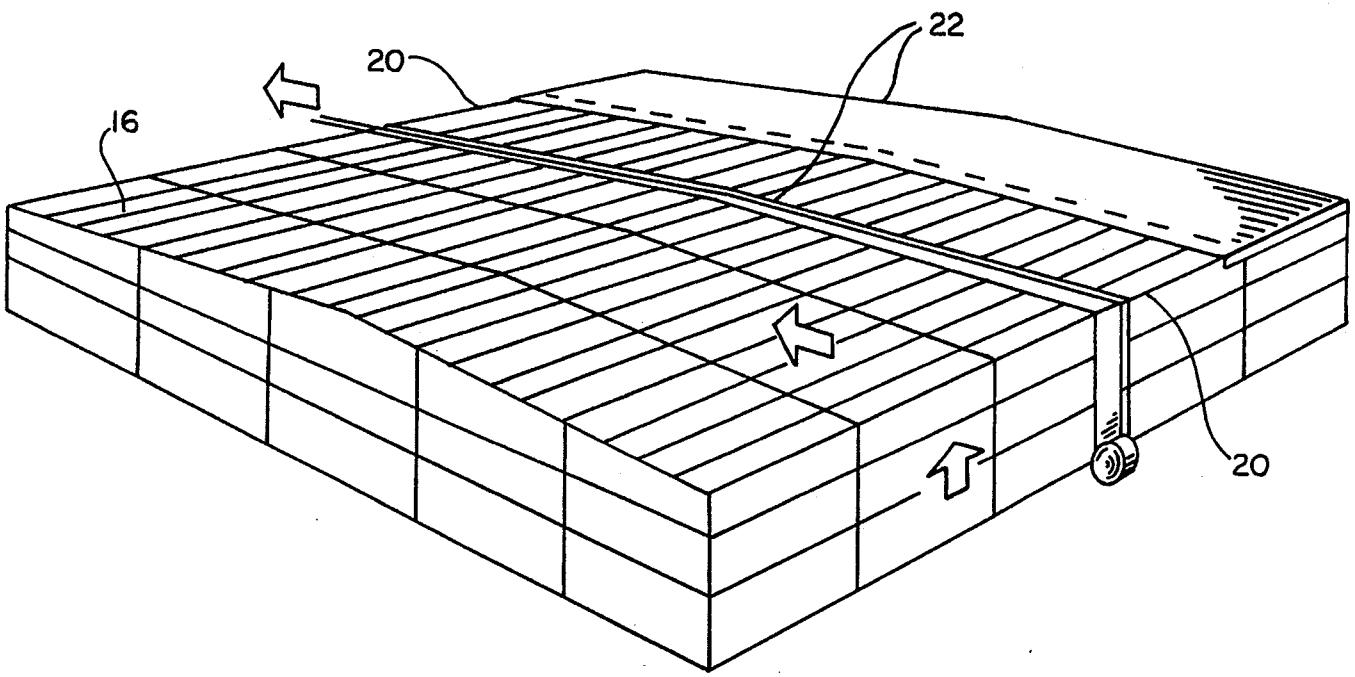
FIG. 5 is an isometric view showing mesh material being installed on a roof frame.

The building shown in FIGS. 1 and 5 has a frame 10 composed of plural pairs of vertical structural members 12, the upper ends of each pair of members being interconnected by a structural beam 14 extending in a direction transverse to the roof ridge line. The transverse beams support an array of parallel purlins 16, each orthogonal to the beams, that is, extending along the length of the building, parallel to the roof ridge line. The purlins are equally spaced, for example at five foot intervals. The purlins may be Z-section members formed from sheet metal. Their exposed ends at either end of the building are capped by gable angles 18. Eave struts 20 are installed at the edges of the roof, each extending parallel to the purlins; the eaves are preferably U-section members whose open sides face toward the center of the roof.

Figure 2:
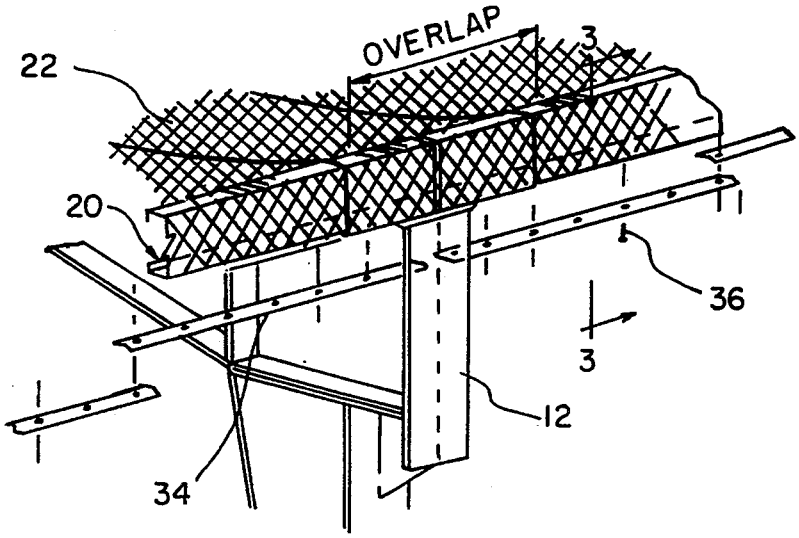
FIG. 2 is view of a portion "P" of FIG. 1, at a greatly enlarged scale.
Figure 6:
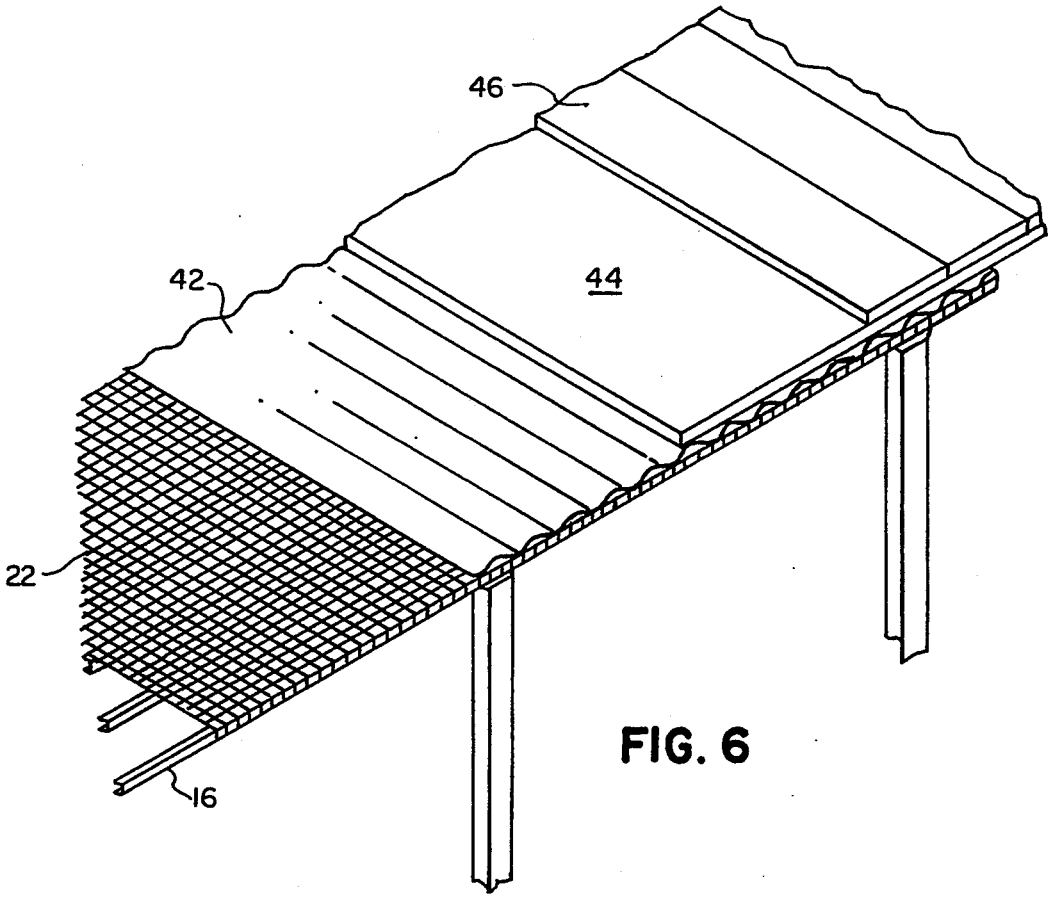
FIG. 6 is an isometric view of a portion of the roof, with each roofing layer partially cut away to reveal the layer beneath.
Figure 7:
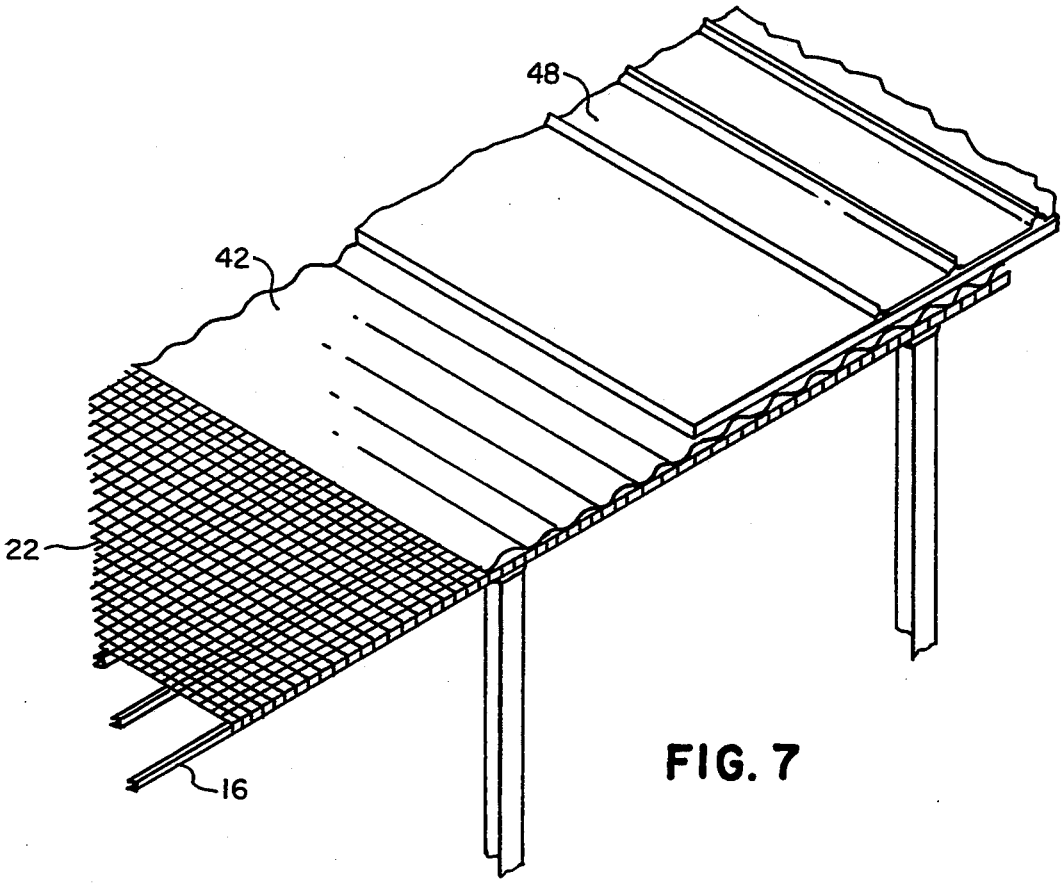
FIG. 7 is a view like FIG. 6, but of an alternative form of the invention.

As FIG. 2 shows, a mesh material 22 is stretched across the roof, directly over the purlins. Corrugated metal decking panels 42 (FIG. 6) are laid over the mesh and affixed to the purlins by rivets or other fasteners, or by spot welding. The decking, once complete, is covered with board insulation 44, and finally the insulation is covered with a waterproof top layer 46 (FIG. 6) or 48 (FIG. 7).

The preferred mesh material is an open polyester scrim mesh interwoven to form a half-inch square grid, coated with a fire retardant polyvinyl chloride binder. The mesh must have sufficient strength to break the fall of a 200–300 pound man from a height of three feet above the plane of the purlins, midway between purlins. For added safety, we require the material to pass this dropping test with a 500 pound weight. A mesh material weighing 2.6 ounces per square yard, and meeting the strength requirements of the preceding sentence, is available from Bay Mills Limited, Ontario, Canada, in rolls seven to ten feet wide. It is identified by Bay Mills as "Bayes Product QX-2220/V".

Figure 4:
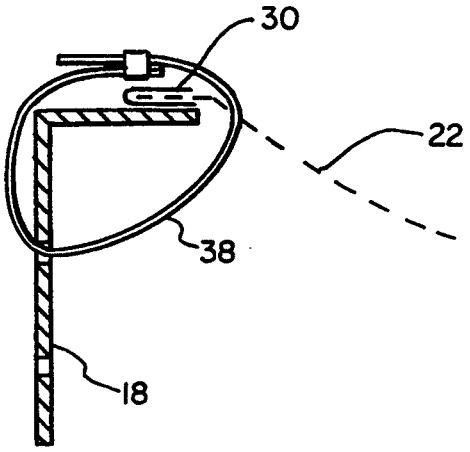
FIG. 4 is a detail taken on the plane 4—4 in FIG. 1.

Standard building bays (the distance between beams) are thirty feet wide. To cover this width, and provide an overlap on either side of about a foot, several widths of the material are spliced together edgewise by two rows of stitching, or other fasteners chosen to provide an edge-to-edge fastening strength as great as that of the material itself. The lateral edges of the material, as received from the manufacturer, are reinforced by a selvedge 30 (FIG. 4), and the leading end of the material is reinforced by a beaded fabric tape 32 sewn over the end. Newly exposed raw ends may be similarly reinforced in the field, optionally with reinforcing rope.

Figure 3:
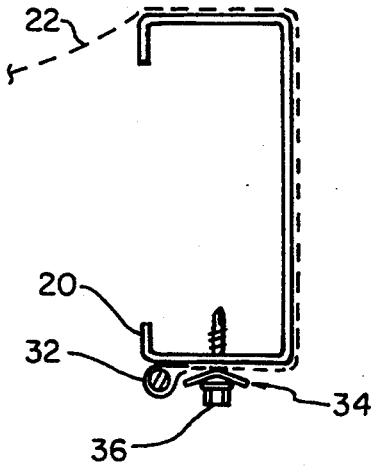
FIG. 3 is a detailed sectional view taken along the plane 3—3 in FIG. 2.

A roll of spliced mesh material, previously folded widthwise several times to a more convenient size before reeling, is positioned to one side of the building, with its axis parallel to the purlins, as shown in FIG. 2. The leading end of the folded mesh is pulled up, over the respective eave strut, and across the purlins to the far eave. The leading end of the mesh is clamped against the far eave strut by a steel strap 34 having a slight dihedral angle, as shown in FIG. 3. The strap is drawn against the structural member by self-drilling or self-tapping screws 36 applied at one-foot intervals. The mesh is secured to the near eave in like manner.

The lateral edges of the material are then affixed to the gable angle 18 or transverse beam 14, as the case may be, by nylon ties 38 at intervals of five feet (along gable angles) or ten feet (elsewhere). After the mesh has been severed along the near eave, the roll is moved a distance equal to its width along the building. The foregoing steps are repeated until the entire roof is covered with mesh.

As a precaution, workers should be tethered to the structure while applying the mesh. Care must be taken not to tear the mesh during installation; an observer should look for tears and report any he discovers. To prevent tearing, the mesh should not be walked on intentionally, even where it overlies the purlins.

Once the entire roof has been covered with mesh, corrugated metal decking 42 is laid over it (and this should be done within sixty days of the mesh installation, since prolonged weathering can have a deleterious effect). During this phase, the strong mesh provides protection against falling, and from dropped objects.

The decking panels are secured to the purlins or joists by sheet metal screws, rivets or other fasteners (which term is meant to include spot welds), and then the panels are overlaid with a layer of rigid board insulation 44 such as Celotex Corporation's "Thermax", or Butler Manufacturing's "CMR-24" insulation.

The insulation is finally covered with a waterproof top layer. If "Thermax" board insulation is used, we prefer to use felt strips, 46 (FIG. 6) impregnated with bitumen, for the top layer. On the other hand, CMR-24 insulation panels, which have their own weatherproof top layer (a layer of sheet metal 48, FIG. 7) already assembled to rigid insulation, are secured by special clips that permit some roof expansion. See U.S. Pat. No. 4,543,760 for details of this clip.

With the present invention, added worker safety is obtained at minimal effort, since the mesh need not be removed; it remains in position for the life of the roof, and thus may subsequently prevent people from falling through skylights, or other openings left in the roof. Additionally, the mesh is inconspicuous, and passes light, so that it can extend beneath skylights without interfering with their function.

The invention of course does not prevent workers from falling off the edge of the building, and while it does provide a measure of added protection, it is not represented to replace currently approved worker safety devices and procedures.

The foregoing description illustrates only one mode—the best now contemplated—of practicing the invention. Many changes can be made to details without departing from the gist of the invention claimed below. For example, the metal decking could be replaced by plastic, plywood, or other materials. Also, the thermal insulation board could be a wood product. And the members referred to as "purlins" could be any functional equivalent, including wooden joists, or truss-type members such as Butler Manufacturing's "Delta Joist".

Inasmuch as the invention is subject to these and other modifications and variations, it is intended that the foregoing description and the accompanying drawings shall be interpreted as illustrative of only one form of the invention, whose scope is to be measured by the following claims.

We claim:

1. A method of safely constructing an insulated roof, comprising steps of erecting a supporting roof substructure including an array of parallel purlins, covering said purlins with a strong nonmetallic mesh material, securing said material to the perimeter of said substructure, covering said mesh material with a layer of sheet metal decking, covering said decking with a layer of rigid thermal insulation, and then covering said rigid thermal insulation with a weatherproof top layer.

2. The invention of claim 1, wherein the covering step comprises drawing said mesh from a roll thereof at ground level onto and across the roof, securing the leading end of the mesh to one eave of the roof, and the trailing end thereof to the other eave, and clamping the lateral edges of the mesh to the corresponding eaves of the roof.

3. A roof construction comprising a plurality of transverse beams, a plurality of spaced, parallel purlins each extending orthogonal to the beams, a nonmetallic mesh extending over and supported by said purlins, a steel roof deck laid over said mesh and supported by the purlins, a layer of rigid board thermal insulation laid over said deck, and a weatherproof top layer.

4. The invention of claim 3, further comprising gable angles extending perpendicular to the purlins at either end of the purlins, the mesh being secured to the gable angles.

5. The invention of claim 3, wherein the roof has eave struts at each edge of the roof, extending parallel to the purlins, the mesh has rope-reinforced leading and trailing ends and is installed with said leading and trailing ends along respective ones of said eave struts, and further comprising means for clamping each of said rope-reinforced end to a respective eave strut.

6. The invention of claim 3, wherein the rigid insulation comprises a wood product.

7. The invention of claim 3, wherein the mesh has sufficient strength to withstand the dropping, from a height of three feet, of a five hundred pound weight upon it at a location between purlins.

8. The invention of claim 3, wherein the weatherproof layer is constructed of felt strips and bitumen.

9. The invention of claim 3, wherein the weatherproof layer comprises sheet metal panels interconnected by weatherproof seams.

* * * * *